US007442266B2

(12) United States Patent
Furuta et al.

(10) Patent No.: US 7,442,266 B2
(45) **Date of Patent: *Oct. 28, 2008**

(54) HIGH-STRENGTH TITANIUM ALLOY AND METHOD FOR PRODUCTION THEREOF

(75) Inventors: Tadahiko Furuta, Aichi (JP); Kazuaki Nishino, Aichi (JP); Takashi Saito, Aichi (JP); JungHwan Hwang, Aichi (JP)

(73) Assignee: Kabushiki Kaisha Toyota Chuo Kenkyusho, Aichi-gun (JP)

( * ) Notice: Subject to any disclaimer, the term of this patent is extended or adjusted under 35 U.S.C. 154(b) by 363 days.

This patent is subject to a terminal disclaimer.

(21) Appl. No.: 10/471,760

(22) Filed: Sep. 26, 2003

(65) Prior Publication Data

US 2004/0115083 A1 Jun. 17, 2004

(30) Foreign Application Priority Data

Mar. 26, 2001 (JP) ..... 2001-088914

(51) Int. Cl.
*C22C 14/00* (2006.01)

(52) U.S. Cl. ..... 148/421; 420/417

(58) Field of Classification Search ..... 148/421, 148/422; 420/417–421, 425, 426, 427
See application file for complete search history.

(56) References Cited

U.S. PATENT DOCUMENTS 5,409,518 A * 4/1995 Saito et al. ..... 75/244
6,607,693 B1 * 8/2003 Saito et al. ..... 420/417
2005/0072496 A1 * 4/2005 Hwang et al. ..... 148/421

FOREIGN PATENT DOCUMENTS

| | | | |
|---|---|---|---|
| EP | 0 707 085 | | 4/1996 |
| EP | 1 046 722 | | 10/2000 |
| EP | 1114876 | A1 * | 7/2001 |
| JP | 52-147511 | | 12/1977 |
| JP | 52147511 | A * | 12/1977 |
| JP | 61-157652 | | 7/1986 |
| JP | 8-299428 | | 11/1996 |
| JP | 10-219375 | | 8/1998 |
| JP | 2002-249836 | | 9/2002 |
| JP | 2002249836 | A * | 9/2002 |
| WO | 00/77267 | | 12/2000 |
| WO | 01-83838 | | 11/2001 |
| WO | WOX 200183838 | A1 * | 11/2001 |

OTHER PUBLICATIONS

"Wrought Titanium and Titanium Alloys", ASM Handbook vol. 2: Properties and Selection Nonferrous Alloys and Special Purpose Materials (2002) p. 1-17.*

* cited by examiner

*Primary Examiner*—Roy King
*Assistant Examiner*—Janelle Morillo
(74) *Attorney, Agent, or Firm*—Oblon, Spivak, McClelland, Maier & Neustadt, P.C.

(57) ABSTRACT

A high-strength titanium alloy of the present invention includes Ti as a major component, 15 to 30 at % Va group element, and 1.5 to 7 at % oxygen (O) when the entirety is taken as 100 atomic % (at %), and its tensile strength is 1,000 MPa or more.

Overturning the conventional concept, regardless of being high oxygen contents, it has been possible to achieve the compatibility between the high strength and high ductility on a higher level.

10 Claims, 5 Drawing Sheets

TEM Observation on Cross-section of Micro-tensile Test Sample

0%

4.3%

6.1%

10.3%

Optical Microscopic Observation on Surface of Micro-tensile Test Sample

Test Sample: $\phi$12 × 18mm / Testing Conditions: Room Temp.,Bees Wax Lubrication, Straining Speed = 0.35sec$^{-1}$ Upsetting Compression Test Upper Punch Surface
Lower Punch Surface
Cross-section of Upsetting Compression Test Sample

HIGH-STRENGTH TITANIUM ALLOY AND METHOD FOR PRODUCTION THEREOF

TECHNICAL FIELD

The present invention relates to a high-strength titanium alloy, by which it is possible to expand the utilization of titanium alloys, and a process for producing the same.

BACKGROUND ART

Since titanium alloy is good in terms of the specific strength and corrosion resistance, it has been used in the fields such as aviation, military, space, deep-sea survey, and chemical plants. Recently, β alloy and the like have been attracting attention, and the usage fields of titanium alloy are about to further expand. For example, titanium alloys which exhibit a low young's modulus are about to be used for products adaptable to living bodies (for instance, artificial bones, etc.), accessories (for example, frames of eyeglasses, etc.), sporting goods (for instance, golf clubs, etc.), springs, and so forth.

Nevertheless, for the purpose of furthermore expanding the utilization of titanium alloys, it is indispensable after all to strengthen them. The mechanical characteristics of titanium alloys, such as the strength, are influenced greatly by the contents of interstitial (solid solution) elements like oxygen (O), nitrogen (N) and carbon (C). For example, when O solves in titanium alloys, it has been well known that their strength is improved. However, previous titanium alloys have been such that their ductility is impaired remarkably while their strength is improved.

Accordingly, in conventional titanium alloys, the admissible contents of interstitial elements such as O have been strictly regulated to predetermined values or less. For example, according to the ASTM (American Society for Testing and Materials) standard, in the case of pure titanium, it is classified as from type 1 to type 4 by the O contents. And, even in type 4 whose O content is the greatest, the content is limited to 1.2 at % (0.4% by mass) or less at the highest.

The circumstance is the same in commercially available titanium alloys as well. For instance, in the Ti-6Al-4V alloy (% by mass) being a multi-purpose α-β alloy, O is limited to 0.6 at % (0.2% by mass) or less, and N is limited to 0.1 at % (0.03% by mass) or less. Moreover, in the Ti-10V-2Fe-3Al alloy being a β alloy, O is limited to 0.5 at % (0.16% by mass) or less, and N is limited to 0.17 at % (0.05% by mass) or less. In addition, in the Ti-3Al-8V-6Cr-4Mo-4Zr alloy being β-C alloy, O is limited to 0.4 at % (0.12% by mass) or less, and N is limited to 0.11 at % (0.03% by mass) or less.

Thus, previous titanium alloys and pure titanium have been such that the contents of interstitial elements such as O are reduced extremely less, and that, even if they are set greater, they are only about 1.2 at % at the highest. Conventional titanium alloys have been such that the balance between the strength and ductility, which are in a trade-off relationship, is established by such an arrangement, however, the strength and ductility have been still insufficient so far so that it has not been possible to furthermore expand the utilization of titanium alloys.

DISCLOSURE OF INVENTION

The present invention has been done in view of such circumstances. Namely, it is therefore an object of the present invention to provide a titanium alloy which overturns the above-described conventional technical common knowledge on titanium alloys and which can balance high strength and ductility on a much higher level, and a production process applicable thereto.

Hence, the present inventors have been studying earnestly in order to solve this assignment, have been repeating trials and errors, and, as a result, have found out that high strength as well as high ductility can be obtained regardless of such a high oxygen content as O is 1.5 at % or more, for example, which seems to be against the conventional technical common knowledge, and have arrived at completing the present invention.

High-Strength Titanium Alloy

Namely, a high-strength titanium alloy according to the present invention comprises titanium (Ti) as a major component, 15 to 30 at % Va group element, and 1.5 to 7 at % oxygen (O), when the entirety is taken as 100 atomic % (at %), wherein its tensile strength is 1,000 MPa or more.

When a large amount of O which is greater than conventional ones by atomic ratio is thus contained in a proper amount of a Va group element, a titanium alloy can be obtained which is of remarkably high strength and in which the reduction of ductility is less (namely, highly ductile).

The detailed mechanism and the like by which the superb characteristic can be obtained has not been necessarily cleared at present. However, the superb characteristic cannot be obtained by the Va group element alone, but apparently results from the fact that the admissible content of O is heightened to such a preposterous level in view of the conventional technical common knowledge. The discovery is epochal in the industries of titanium alloy, and is very meaningful academically as well. And, the present high-strength titanium alloy can be used in a variety of products because of the superb characteristic, and shows great forces in improving the functions of various products and expanding the degree of designing freedom.

Next, when the characteristics are described more specifically, it is possible to obtain such high strength that a tensile strength is 1,000 MPa or more. And, it is possible to obtain an extraordinarily high-strength titanium alloy as well whose tensile strength is 1,100 MPa or more, 1,200 MPa or more, 1,400 MPa or more, 1,500 MPa or more, 1,600 MPa or more, further 2,000 MPa or more. Such high strength that a tensile strength is from 2,000 MPa to 2,100 MPa is the strongest in titanium alloys existing so far, and it is possible to say that it is exactly amazing high strength.

In addition, the present titanium alloy is good because it has sufficient ductility though it is of such high strength. Of course, even in the present titanium alloy, it is likely that, similarly to conventional titanium alloys, as it can be of such high strength that the ductility lowers more or less. However, the lowering tendency of the ductility is far less than conventional ones, and the correlation between the strength and ductility is on a high level which surpasses far beyond conventional level.

For example, even when it is of above-described high strength exceeding 2,000 MPa, it exhibits an elongation of 3% or more. Considering the fact that the elongation of a conventional high-strength titanium alloy (approximately 1,900 MPa) is substantially 0% or close to it, it is understood how the present titanium alloy is of high strength and high ductility.

Moreover, when high strength is required, depending on usage, there are cases where such high strength exceeding 2,000 MPa is not needed. If such is the case, it is possible to obtain a titanium alloy which exhibits a much higher elongation. Specifically, it is possible to obtain a titanium alloy whose elongation is 4% or more, 5% or more, 7% or more, 9% or more, 11% or more, 13% or more, 15% or more, 18% or more, further 20% or more.

And, it is possible to appropriately combine these strength and elongation. For example, when the tensile strength is 1,200 MPa or more, it can be combined with an arbitrary elongation falling in a range of from 3 to 21%. Moreover, when the tensile strength is 1,400 MPa or more, it can be combined with an arbitrary elongation falling in a range of from 3 to 12%. In addition, when the tensile strength is 1,600 MPa or more, it can be combined with an arbitrary elongation falling in a range of from 3 to 8%. To be more specific, for instance, when the tensile strength is 2,000 MPa, the elongation can be 3% or more, when the tensile strength is 1,800 MPa, the elongation can be 5% or more, when the tensile strength is 1,500 MPa, the elongation can be 10% or more, and when the tensile strength is 1,300 MPa, the elongation can be 15% or more, and so on. Note that, in the present specification, the "elongation" means an elongation at fracture after tensile deformation.

By the way, since conventional titanium alloys are such that it is intended to limit the content of O which is very likely to combine with Ti, much time, costs, special facilities and the like are required to produce them.

In this regard, since the present titanium alloy utilizes the O content contrarily, the oxygen control is easier comparatively than it has been done conventionally, and accordingly there arise such merits that it is possible to reduce the time requirements, manufacturing costs, and so forth.

So far, the present titanium alloy has been described mainly which contains a large amount of O, however, it is well known that the N and C being interstitial elements act in the same manner as O, and this is apparent theoretically. From this point of view, it is needless to say that it is effective to substitute N or C for all or a part of the above-described O.

Hence, the present invention can be a high-strength titanium alloy that includes Ti as a major component, 15 to 30 at % Va group element, and 1.5 to 7 at % N when the entirety is taken as 100 at %, wherein its tensile strength is 1,000 MPa or more.

Moreover, the present invention can be a high-strength titanium alloy that includes Ti as a major component, 15 to 30 at % Va group element, and 1.5 to 7 at % C when the entirety is taken as 100 at %, wherein its tensile strength is 1,000 MPa or more.

In addition, the present invention can be a high-strength titanium alloy that includes Ti as a major component, 15 to 30 at % Va group element, and 1.5 to 7 at % N and C in a summed amount when the entirety is taken as 100 at %, wherein its tensile strength is 1,000 MPa or more.

Note that the lower limit value of the O content and the like is determined from desired strength, and the upper limit value is determined from the viewpoint of securing practical ductility, toughness and so forth of titanium alloys. And, other than the aforementioned composition ranges, the lower limit value of O can be 1.8 at %, 2.0 at %, 2.4 at %, 2.6 at %, 2.8 at %, 3 at %, 4 at %, and so on. Moreover, the upper limit value of O can be 6.5 at %, 6 at %, 5.5 at %, 5 at %, 4.5 at %, and the like. And, it is possible to appropriately combine these lower limit values and upper limit values, for example, O can be from 1.8 to 6.5 at %, from 2.0 to 6.0 at %, and so forth.

Indeed, when the interstitial elements such as O are from 2.0 to 5.0 at % in a summed amount, the balance between the strength and ductility is good. In particular, in view of strength, from 3.0 to 5.0 at % is preferable, and, in view of ductility, from 2.0 to 4.0 at % is preferable.

Moreover, when O is contained mainly as the interstitial element, from the viewpoint of substituting or compensating for a part of the O, N as a similar interstitial element can be included in an amount of from 0.2 to 5.0 at %, desirably from 0.7 to 4.0 at %. Likewise, C can be included in an amount of from 0.2 to 5.0 at %, desirably from 0.2 to 4.0 at %.

As the Va group element, there are vanadium (V), niobium (Nb), tantalum (Ta) and protoactinium (Pa). However, from the view point of showing high strength and high ductility, and from the viewpoint of handlability and the like, either one or more of V, Nb and Ta can be used actually. Among them, in the case of the present titanium alloy, Nb and Ta are especially suitable.

The reason has not been definite yet, however, it is believed at present as follows. Specifically, in the β phase in which Nb or Ta is a major constituent element, even when O and the like are contained in a large amount, it is assumed that some kind of action works, action which is different from the conventional mechanism that O and so forth segregate at grain boundaries to cause embrittlement.

The lower limit value of the Va group element is also determined from the viewpoint of securing sufficiently high strength, and, when the Va group element is contained in an amount exceeding the upper limit value, the material segregation is likely to occur, and sufficiently high strength cannot be obtained after all. Hence, the Va group element content is controlled in the aforementioned composition range, however, it is not limited thereto, the lower limit value can be 20 at %, 23 at %, and the like. Moreover, the upper limit value can be 27 at %, 26 at %. And, they can be combined arbitrarily so that the sum of the Va group element is from 18 to 27 at %, further from 20 to 25 at %.

Hereinafter, for convenience, descriptions will be often given on a high-strength titanium alloy with a high O content, however, it is not purported to eliminate high-strength titanium alloys comprising a high N content and the like from the present invention.

Production Process of High-Strength Aluminum Alloy

The aforementioned high-strength titanium alloy can be produced by a variety of production processes, however, the present inventors simultaneously developed even processes suitable for the production.

Specifically, a process for producing a high-strength titanium alloy according to the present invention comprises: a compacting step of pressure-forming a raw material powder comprising Ti and a Va group element at least; a sintering step of sintering and heating a compacted body obtained in the compacting step; and a hot working step of hot-working to compact a sintered billet obtained in the sintering step; whereby a high-strength titanium alloy, comprising 15 to 30 at % Va group element and 1.5 to 7 at % O when the entirety is taken as 100 at %, is obtained.

By not using the so-called melting method but a sintering method, even when the Va group element and O are included in large amounts, titanium alloys with stable qualities (high strength and high ductility) can be obtained while avoiding macro segregation. Then, since a sintering method is used, no great time requirements or costs, special apparatuses and the like are needed. Thus, in accordance with the present production process, it is possible to produce the aforementioned high-strength titanium alloy with good efficiency.

Note that the composition of the raw material powders used in the present production process does not necessarily agree with the composition of the resulting titanium alloys. For example, O and the like fluctuate depending on atmospheres in which sintering is carried out.

It is suitable that the present production process be further provided with a cold working step, in which the sintered billet after the hot working step is subjected to cold working.

When cold working is applied, the strength of the present titanium alloy is further improved. In addition, the titanium alloys obtained by the present production process hardly cause such work hardening as occurred in conventional titanium alloys, and show very good cold working property (super plasticity). And, although the strength is upgraded by the aforementioned cold working step, the lowering of the ductility (elongation and the like) is extremely less.

Note that, when the compositional ranges of the aforementioned respective elements are specified as "'x' to 'y' atomic %" in the present specification, this includes the lower limit value "x" and upper limit value "y" unless otherwise specified in particular. This is also the same when specifying as "'x' to 'y' % by weight."

Moreover, note that the "high strength" set forth in the present application means that the tensile strength (tensile strength) is great. The "tensile strength" is, in a tensile test, a stress obtained by dividing a load immediately before the final rupture of a test sample with the cross-sectional area of the parallel portion of the test sample before the test.

In addition, the "high-strength titanium alloy" set forth in the present invention includes a variety of forms, it is not limited to raw materials (for example, slabs, billets, sintered bodies, rolled products, forged products, wires, plates, rods, and the like), but it implies even titanium alloy members (for instance, intermediately-processed products, final products, parts of them, and so forth) which are formed by processing them (being the same hereinafter).

BEST MODE FOR CARRYING OUT THE INVENTION

A. Mode for Carrying Out

Figure 1:
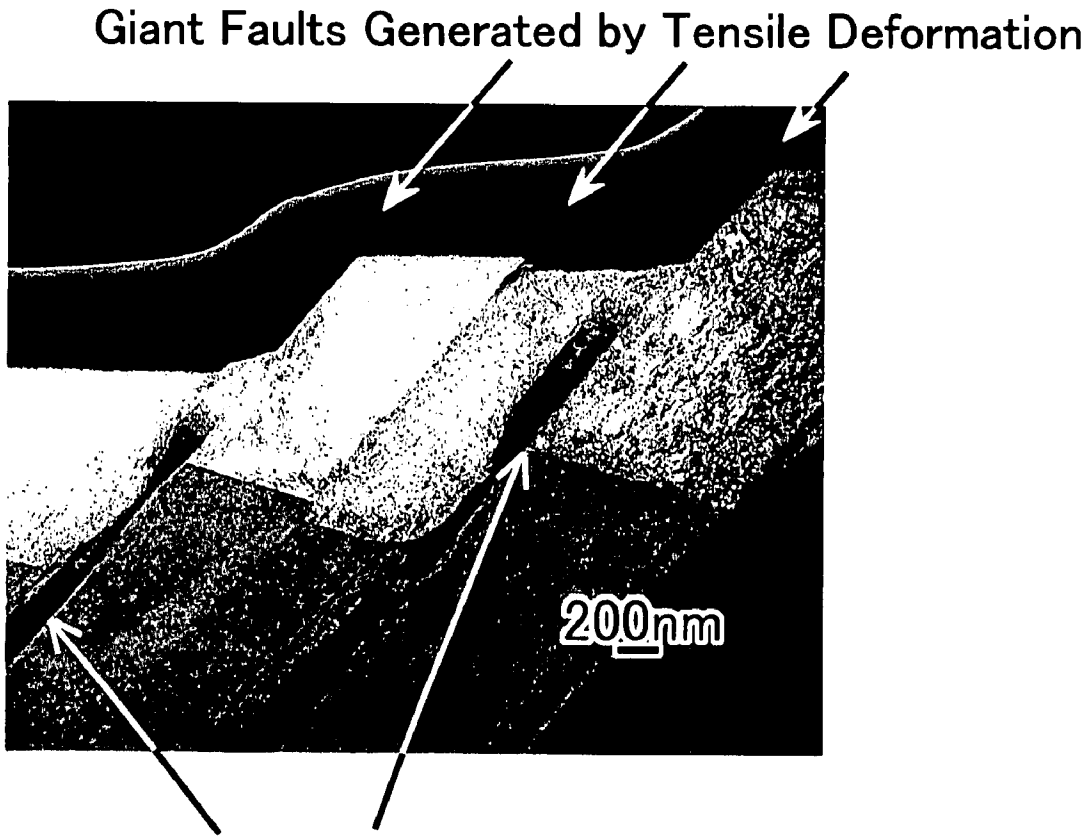
FIG. 1 is a TEM photograph for illustrating a fault-shaped deformation structure of a titanium alloy of the present invention.
Figure 2A:
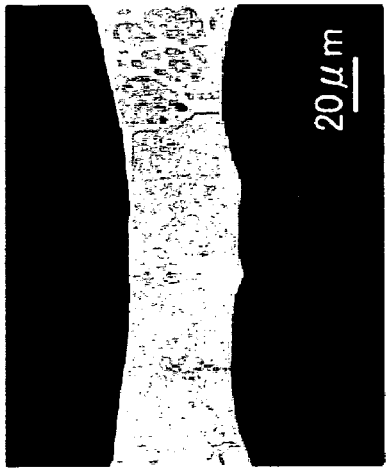
FIG. 2A is a microscope photograph for illustrating a deformation mechanism of a titanium alloy of the present invention when a tensile transformation ratio is 0%.
Figure 2B:
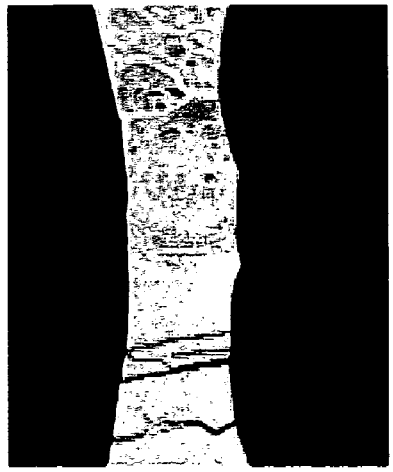
FIG. 2B is a microscope photograph for illustrating a transformation mechanism of a titanium alloy of the present invention when a tensile transformation ratio is 4.3%.
Figure 2C:
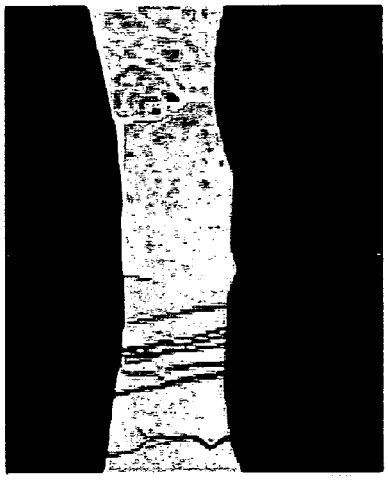
FIG. 2C is a microscope photograph for illustrating a transformation mechanism of a titanium alloy of the present invention when a tensile transformation ratio is 6.1%.
Figure 2D:
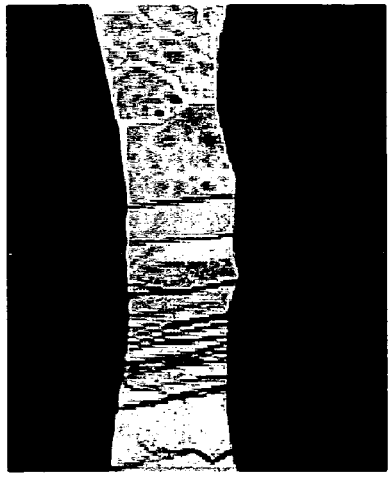
FIG. 2D is a microscope photograph for illustrating a transformation mechanism of a titanium alloy of the present invention when a tensile transformation ratio is 10.3%.

Hereinafter, while naming embodiment modes, the present invention will be described in more detail.

High-Strength Titanium Alloy

(1) Composition

① It is suitable that the present titanium alloy can further include either one or more metallic elements selected from the group consisting of zirconium (Zr), hafnium (Hf) and scandium (Sc) in a summed amount of 0.3 at % or more, wherein Zr is 15 at % or less, Hf is 10 at % or less, and Sc is 30 at % or less.

All of Zr, Hf and Sc are elements which can improve the proof stress of titanium alloys. However, when the sum of them exceeds 15 at %, the material segregation is likely to occur so that it is not possible to desire to upgrade the strength and ductility, and moreover it is not preferable because it results in enlarging the density of titanium alloys (lowering the specific strength).

By the way, when Zr or Hf is included in titanium alloys independently, it is preferable to be from 1 to 10 at %, further from 5 to 10 at %, respectively, and, in the case of Sc, it is more preferable to be from 1 to 20 at %, and further from 5 to 10 at %.

② It is suitable that the present high-strength titanium alloy can further include Sn in an amount of from 1 to 13 at % or less. Sn is an element which can enhance the strength of titanium alloys. When it is less than 1 at %, no effect of Sn is available, and, when it exceeds 13 at %, it is not preferable because it results in lowering the ductility of titanium alloys.

③ In addition to Zr, Hf, Sc and Sn, the present high-strength titanium alloy can further include, within ranges enabling the high strength to sustain or improve, either one or more elements selected from the group consisting of Cr, Mo, Mn, Fe, Co, Ni, Al and B in a summed amount of 0.1 at % or more.

And, for example, it is suitable that Cr, Mn and Fe can be 30 at % or less, Mo can be 20 at % or less, and Co and Ni can be 13 at %, respectively.

Moreover, it is suitable that Al can be from 0.5 to 12 at %, and B can be from 0.2 to 6.0 at %.

Note that, regarding these compositions, the same is likewise true for the raw material powders used in the present production process.

Deformation Structure in Cold Working

The present high-strength titanium alloy is improved in term of the mechanical characteristics (dynamic qualities) by cold working. Additionally, the present high-strength titanium alloy is such that it is possible to say that no work hardening occurs at all, and shows such a good cold working property that it is not conceivable in conventional titanium alloys. The present inventors thought of reasoning as follows why such phenomena arise.

Specifically, when the present high-strength titanium alloy is subjected to cold working, work elastic strain is given therein. The thus introduced work elastic strain can facilitate to further strengthen the titanium alloy. In view of fully introducing the work elastic strain into the constitution structure of the titanium alloy, the above-described proper amounts of the Va group element and interstitial elements such as O are important.

In particular, the interstitial elements such as O play an important role in the introduction of the work elastic strain. To put it the other way around, in titanium alloys in which a large amount of Va group element is added independently, it is difficult to fully introduce the work elastic strain into the constitution structure. In addition to the Va group element, when the proper amount of the interstitial elements such as O is included in the titanium alloy, it is possible to introduce sufficient work elastic strain into the titanium alloy, and it is possible to furthermore highly strengthen the titanium alloy by the accumulation.

Moreover, the present inventors repeated wholehearted studies after completing the present invention, as a result, the mechanism became apparent more particularly. The details will be hereinafter explained.

The present titanium alloy is such that the plastic deformation is caused by a deformation mechanism which is totally different from those of general metallic materials involving conventional titanium alloys. Specifically, conventional metallic materials so far are such that the plastic deformations are caused by "slipping deformation" or "twining deformation" to which dislocation movements contribute, and further by deformation to which "martensitic transformation" contributes like shape memory alloys.

On the other hand, it become apparent that the present high-strength titanium alloy is such that the plastic deformation is caused by a novel and unique elastic deformation mechanism which is totally different from those transformation mechanisms. FIG. 1, a TEM (transmission electron microscope) photograph, illustrates how the plastic deformation mechanism operates.

From FIG. 1, it is understood that, when a test sample undergoes plastic deformation, not dislocation actions on slipping planes, but giant "faults" along maximum shear planes contribute to it. Specifically, when the present titanium alloy is subjected to cold working (especially, heavy working), in all over the alloy, the giant faults arise intermittently along the maximum shear planes, and recombine immediately thereafter. Due to the repetitions, the present titanium alloy lets the macro plastic deformation develop. And, as the cold working ratio (described later) increases, a large number of intermittent faults arise successively inside the present titanium alloy, and the plastic deformation develops without destruction. FIGS. 2A through 2D illustrate the appearance of faults which arose when the cold working ratio was varied sequentially. For reference, the steps resulting from the faults was from 200 to 300 nm approximately in the case of FIG. 1, but depended on the cold working ratios, raw materials (test samples) and the like so that they were not constant.

Note that the test sample shown in FIG. 1 and FIGS. 2A through 2D was a sintered billet having a composition of Ti-20Nb-3.5Ta-3.5Zr (at %) to which a heat treatment was carried out at 900° C. for 30 minutes after subjecting it to hot working at 1,100° C. Moreover, the plastic deformations were caused by a tensile test.

In addition, FIGS. 2A through 2D are such that the test sample (width 40 μm×length 150 μm at the measured portion) was subjected to machining and ion grinding and thereafter the surface was observed with an optical microscope. And, FIG. 1 is a photograph in which the cross-section of FIG. 2D was observed with TEM.

Figure 3A:
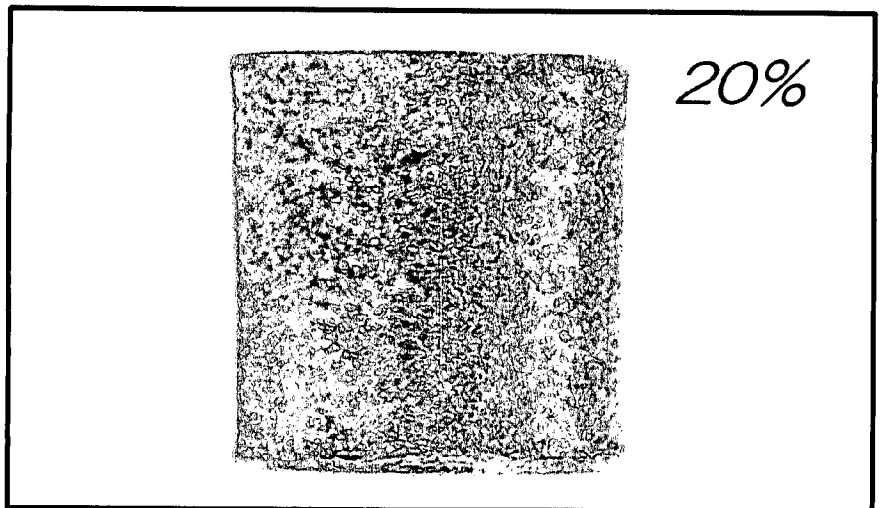
FIG. 3A is a photograph for illustrating a test sample when a titanium alloy of the present invention is subjected to upset compression and a cold working ratio is 20%.
Figure 3B:
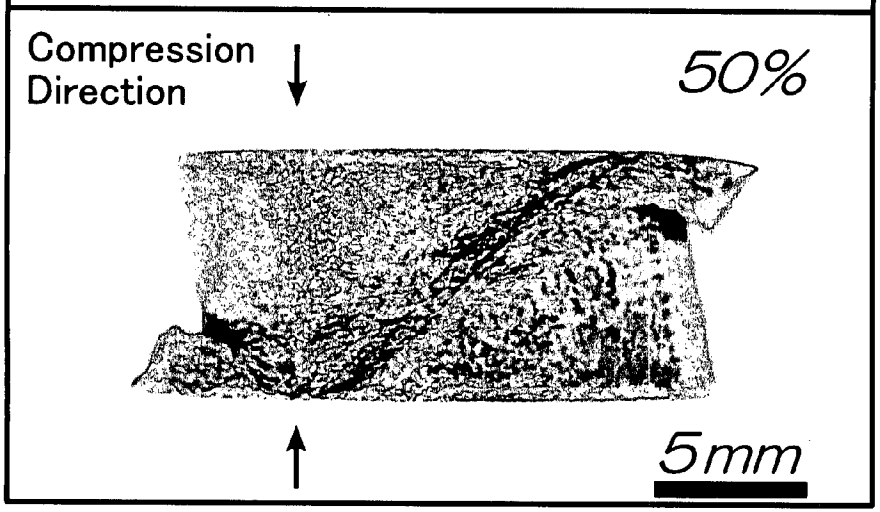
FIG. 3B is a photograph for illustrating a test sample when a titanium alloy of the present invention is subjected to upset compression and a cold working ratio is 50%.
Figures 4A, 4B, 4C:
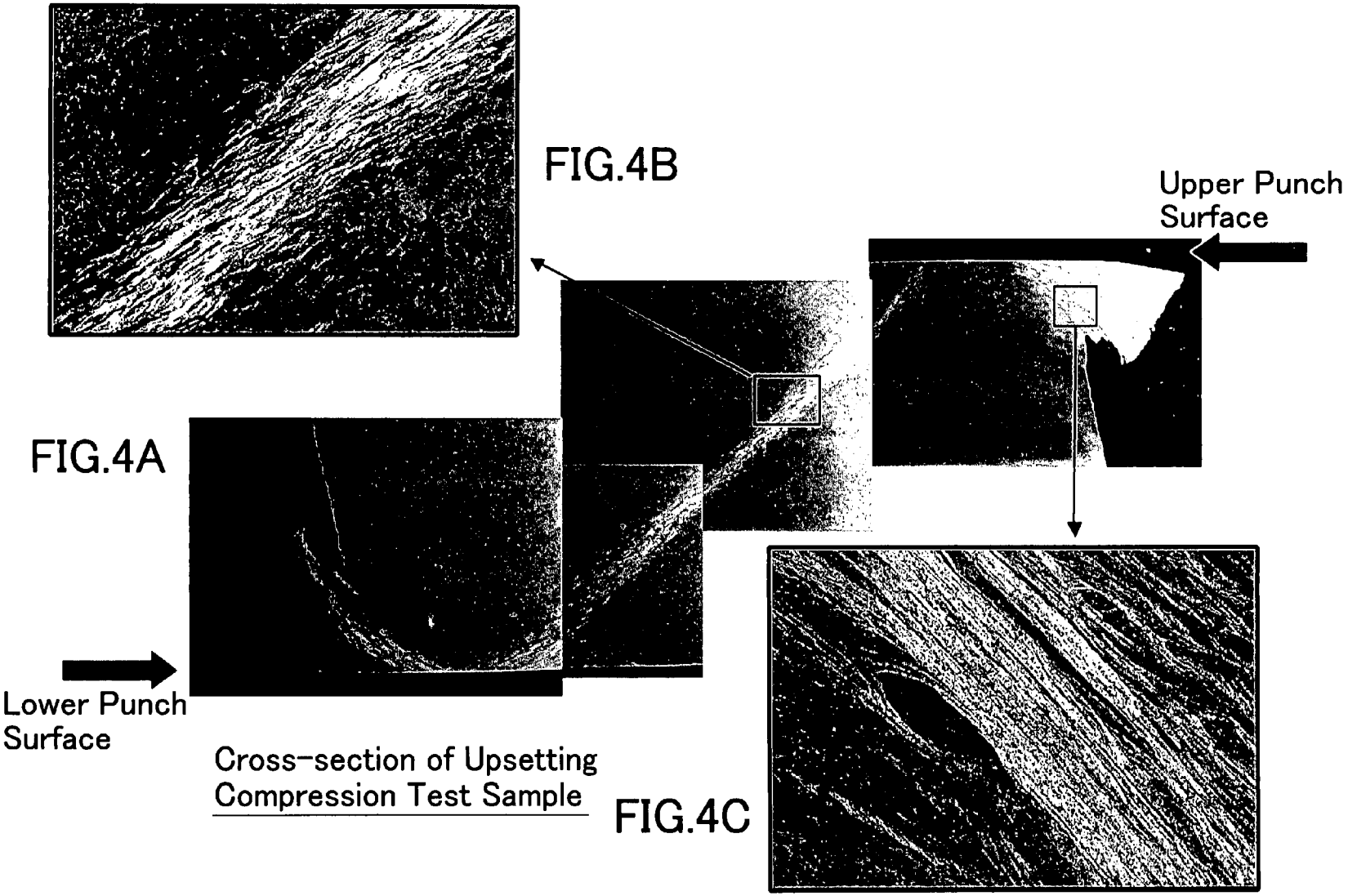
FIG. 4A is an SEM photograph for enlarging an entire fault which appeared in the test sample illustrated FIG. 3B.
FIG. 4B is an SEM photograph for enlarging a part in FIG. 4A.
FIG. 4C is an SEM photograph for enlarging a part in FIG. 4A.

Further, FIGS. 3A and 3B as well as FIGS. 4A through 4C are macrophotographs showing faults occurred when cold working was applied to the present titanium alloy, and how they recombined.

FIGS. 3A and 3B show a sintered billet (size: ϕ 12×18 mm) having a composition of Ti-20Nb-3.5Ta-3.5Tr (at %) to which a heat treatment was carried out at 900° C. for 30 minutes (subsequently cooled with water) after subjecting it to hot working at 1,100° C. And, FIG. 3A is such that the test sample was subjected to upsetting compression (swaging: cold working) with 20% cold working ratio. Moreover, FIG. 3B is such that it was subjected to upsetting compression with 50% cold working ratio. When the cold working ratio is 20%, there occurs no large fault which can be recognized visually on the surface of the test sample. However, when the cold working ratio is 50%, it is understood that there occur faults which are large enough to recognize even visually on the maximum shear plane (45° plane).

Next, FIGS. 4A through 4C show the vertical cross-section of the test sample shown in FIG. 3B when it was cut parallelly to the compression direction (upsetting direction) and was ground, and how the faults were looked like when they were enlarged with SEM to observe. FIG. 4A enlarges the faults by 15 times, FIG. 4B enlarges a part of the faults shown in FIG. 4A by 50 times, and FIG. 4C enlarges a part of the faults shown in FIG. 4A by 200 times.

It is apparent from FIG. 4B and FIG. 4C that a large number of the faults (linear striped patters) appear, however, when observing all of FIG. 4A as well as FIGS. 4B and 4C, the enlarged photographs thereof, it is not possible to find out places where the faults are cut off in anywhere. Namely, the generated faults are recombined definitely. Therefore, it is apparent that the faults emerged in FIG. 3B are not resulted from destruction.

Hereinafter, descriptions will be given on how the unique deformation mechanism by means of the faults is related to the high strength and high ductility of the present titanium alloy.

First, as described above, the general deformation mechanism of conventional metallic materials develops the plastic deformation by means of the movement and propagation of dislocation. Interstitial elements entered the metallic materials act to inhibit the movement of dislocation. As a result, the more the interstitial elements are increased, the more the conventional metallic materials are inhibited from deforming plastically so that it is of higher strength. However, when the movement of dislocation is inhibited frequently by the increment of the interstitial elements, there arise areas where the dislocation density is extremely high. Then, the portions make the starting points or paths of destruction. Accordingly, metallic materials including a large amount of interstitial elements cannot produce sufficient plastic deformation, and arrive at destruction. Specifically, in the case of conventional metallic materials, although the increment of interstitial elements improves the strength, it even causes to sharply lower the ductility.

On the other hand, the present titanium alloy is such that dislocation and the like hardly exist there in even after cold working, and the plastic deformation develops by means of the generation and recombination of the above-described faults. Then, it become apparent by a TEM observation that the crystalline lattices present in the vicinity of the boundary planes of the faults are curved greatly. The curving of the crystalline lattices forms a discrete elastic strain field having a layered structure which is from nanometer-size to micrometer-size and further extends to millimeter-size. Then, it accumulates the work energy applied by cold working inside the alloy as elastic strain energy. In the present titanium alloy, as the content of interstitial elements increases, the elastic strain energy which can be accumulated the inside increases as well so that the stress required for generating the faults goes up. Namely, the stress required for developing the plastic deformation increases. Thus, it is believed that the present titanium alloy is improved remarkably in terms of the strength as the content of interstitial elements increases.

Subsequently, when a stress (work energy) which is sufficient to generate the faults is applied to the present titanium alloy, the faults arise anew to develop the plastic deformation, however, the faults recombine instantaneously. Accordingly, the present titanium alloy does not arrive at destruction even when the plastic deformation occurs, and shows good ductility.

As can be seen from the above descriptions, the present titanium alloy is such that the plastic deformation mechanism is fundamentally different from the conventional deformation mechanism, and is completely novel. And, against the conventional technical common knowledge and the like, by increasing interstitial elements, it is achieved successfully to make the high strength and the high ductility compatible, which has been impossible to achieve conventionally.

When reconsidering based on these facts, the present invention can be grasped as a high-strength titanium alloy as well which is characterized in that it has a fault-shaped deformation structure by first subjecting it to cold working and its tensile strength is 1,100 MPa or more. It is sufficient that the high-strength titanium alloy has a deformation structure by means of the novel faults (fault-shaped deformation structure) which is totally different from the conventional deformation mechanism. Accordingly, the content of interstitial elements cannot necessarily be high as described above. Indeed, when interstitial elements are rather contained in a relatively large amount as described above, it is possible to obtain a titanium alloy of much higher strength. Hence, it is suitable that the present titanium alloy comprise titanium (Ti) as a major component, 15 to 30 at % Va group element, and 1.5 to 7 at % oxygen (O), for example, when the entirety is taken as 100 at %. Of course, N and C can substitute for O.

Note that the "fault-shaped deformation structure" is a structure comprising the faults as shown in FIG. 1. It is not slipping deformations to which dislocation contributes like the conventional ones, nor the twining deformation structures, nor even deformation structures to which martensitic deformation contributes.

Moreover, in the above-described present titanium alloy, the lower limit value of the tensile strength is controlled at 1,000 MPa, however, since it is of much higher strength by cold working, the lower limit value is controlled herein at 1,100 MPa.

In addition, regarding the tensile strength, elongation and the combinations of both numerical values, the above-described details are also applicable to the high-strength titanium alloy having the fault-shaped deformation structure.

B. Production Process of High-Strength Titanium Alloy

(1) Raw Material Powder

A raw material powder includes, for example, from 15 to 30 at % Va group element, an interstitial element such as O, N or C, and titanium (Ti). It can be adjusted so that the composition of the eventually obtained titanium alloy is from 15 to 30 at % Va group element, and from 1.5 to 7 at % O when the entirety is taken as 100 atomic % (at %).

Moreover, regardless of the composition, a raw material powder including Ti and a Va group element at least can be used to obtain a high-strength alloy having a fault-shaped deformation structure. Specifically, the present production process can be characterized in that it comprises: a compacting step of pressure-forming a raw material powder comprising Ti and a Va group element at least; a sintering step of sintering and heating a compacted body obtained in the compacting step; a hot working step of hot-working to compact a sintered billet obtained in the sintering step; and a cold working step of cold-working the sintered billet after the hot working step; whereby a high-strength titanium alloy, having a fault-shaped deformation structure, is obtained.

In addition to Ti, a Va group element and an interstitial element such as O, the composition contained by the raw material is determined based on the compositions of the above-described titanium alloys. For example, the raw material powder can include either one or more elements selected from the group consisting of Zr, Hf and Sc, and further Sn, Cr, Mo, Mn, Fe, Co, Ni, C and B.

When either one or more metallic elements selected from the group of Zr, Hf and Sc are included in the raw material powder, the raw material powder can be prepared so that the resulting high-strength titanium alloy includes the metallic elements in a summed amount of 0.3 at % or more, and Zr is 15 at % or less, Hf is 10 at % or less, and Sc is 30 at % or less when the entirety is taken as 100 at %.

As the raw material powder, for instance, it is possible to use sponge powders, hydrogenated-and-dehydrogenated powders, hydrogenated powders, atomized powders, and the like. The particulate shapes and particle diameters (particle diameter distributions) of the powders are not limited in particular, but it is possible to use commercially available powders. Indeed, when the average particle diameter is 100 μm or less, further 45 μm (#325) or less, it is preferable because dense sintered bodies can be obtained. Moreover, the raw material powder can be mixture powders in which elementary powders are mixed, or alloy powders which have desired compositions.

Moreover, the raw material powder can be mixture powders in which high-oxygen Ti powders or high-nitrogen Ti powders are mixed with alloying element powders including the aforementioned Va group elements. And, when high-oxygen Ti powders are used, it is easy to control the O content so that the productivity of the titanium alloy according to the present invention is improved. It is likewise applicable to high-nitrogen Ti powders. Such high-oxygen Ti powders can be obtained, for example, by an oxidizing step in which Ti powders are heated in oxidizing atmospheres.

The mixing step can be carried out by using a type "V" mixer, a ball mill and a vibration mill, a high-energy ball mill (for example, an attritor), and so forth.

(2) Compacting Step

The compacting step can be carried out, for instance, by using die forming, CIP compacting (cold isostatic press compacting), RIP compacting (rubber isostatic press compacting), and so on. Indeed, when the compacting step is a step in which said raw material powder is CIP compacted, it is preferable because it is relatively easy to obtain dense compacted bodies.

Note that the shapes of compacted bodies can be final shapes of products or shapes close thereto, or even the shapes of billets being intermediate products, and the like.

(3) Sintering Step

When compacted bodies are sintered, it is preferable to do it in vacuum or in inert gas atmospheres. Moreover, the sintering temperature can preferably be the melting point or less of titanium alloys, and additionally it can preferably be carried out in a temperature range where the component elements fully diffuse. For example, it is preferred that the temperature range can be from 1,200° C. to 1,600° C., further from 1,200° C. to 1,500° C. It is preferred that the sintering time can be from 2 to 50 hours, further from 4 to 16 hours.

(4) Hot Working Step

By carrying out the hot working step, it is possible to compact the structure by reducing voids and the like in sintered alloys. The hot working step can be carried out by hot forging, hot swaging, hot extruding, and so forth. The hot working step can be carried out in any atmospheres such as in air and in inert gas atmospheres. In view of controlling facilities, it is economical to carry it out in air. The hot working referred to in the present production process is carried out in order to compact sintered bodies, but can be carried out combinedly with the forming while taking the shapes of products into consideration.

(5) Cold Working Step

As described above, the titanium alloy according to the present invention exhibits a good cold working property, when it is subjected to cold working, the mechanical characteristics are improved. Hence, the present production process can preferably be provided with a cold working step in which cold working is carried out after said hot working step.

Here, the "cold" designates low temperatures which are lower than the recrystallization temperature of titanium alloy (the lowest temperature causing the recrystallization). Although the recrystallization temperature depends on the compositions, in the case of the present titanium alloy, it is about 600° C. in general. Then, the present titanium alloy is ordinarily cold worked in a range of from ordinary temperature to 300° C.

Moreover, the cold working ratio "X"% indexing the extent of the cold working is defined by the following equation.

X=(Variation of Cross-Sectional Areas before and after Working: $S_0-S$)/(Initial Cross-Sectional Area before Working: $S_0$)×100%, ($S_0$: Initial Cross-Sectional Area before Cold Working, and S: Cross-Sectional Area after Cold Working)

In the case of the present titanium alloy, the cold working ratio can be 10% or more, 30% or more, 50% or more, 70% or more, 90% or more, and further 99% or more. And, in accordance with the elevation of the cold working ratio, the strength of the titanium alloy is improved.

The cold working step can be carried out by cold forging, cold swaging, wire drawing with dies, drawing, and the like. Moreover, the cold working can be carried out combinedly with product forming. Specifically, titanium alloy obtained after the cold working can be formed as raw materials such as rolled stocks, forged stocks, plates, wires and rods, or can be formed as objective final shapes of products or shapes close thereto. Moreover, the cold working can preferably be carried out at raw-material stages, but not limited thereto, can be carried out, after shipping raw materials, at stages in which they are processes them into final products at respective makers, and so forth.

(6) Age Treatment (Age-Treatment Step)

The present titanium alloy or the production process therefor do not necessarily require heat treatments, however, it is possible to achieve much higher strength by carrying out an appropriate heat treatment. As the heat treatment, for example, an age treatment is available. To be more precise, for instance, it is suitable when a heat treatment can be carried out at 200° C. to 600° C. for 10 minutes to 100 hours (note that it is possible to appropriately set the heating time other than the range).

When the cold working is executed prior to the age treatment, the precipitation sites emerging by aging increase. When fine precipitation phases are dispersed in large numbers, it is possible to strengthen titanium alloys to much higher extent. When the aging treatment is carried out, it is possible to obtain super-strong titanium alloys, whose tensile strength is 1,400 MPa or more, 1, 600 MPa or more, 1,800 MPa or more and further 2,000 MPa or more, with ease.

Usage of Titanium Alloy

Since the present titanium alloy is of higher strength than conventional ones, it can be used extensively in products which match the characteristics. Moreover, since it is highly ductile and is provided with a good cold working property, when the present titanium alloy is used in cold-worked products, work cracks and the like can be reduced remarkably, and the material yield and so forth can be improved. Accordingly, in accordance with the present titanium alloy, even products made of conventional titanium alloys and requiring machining and so on in view of the shapes can be formed by cold forging and the like so that it is very effective in mass-producing the titanium products and lowering the costs.

Specifically, for example, the present high-strength titanium alloy can be used in industrial machines, automobiles, motorbikes, bicycles, household electric appliances, aero and space apparatuses, ships, accessories, sports and leisure articles, products relating to living bodies, medical equipment parts, toys, and the like.

Further, when a frame of eyeglasses, being one of accessories, is exemplified, because it is of high strength and high ductility, it is easy to process from fine wires to a frame of eyeglasses, and it is possible to improve the material yield. Moreover, in accordance with the frame of eyeglasses made from the fine wires, the fitting ability, lightness and worn feeling of the eyeglasses can be further improved.

Furthermore, as an applicable example to sports and leisure articles, it is possible to name a golf club. For example, when a head of a golf club, especially, a face part comprises the present high-strength titanium alloy, by the thinning resulting from the utilization of the high strength, it is possible to remarkably reduce the intrinsic frequency of the head than conventional titanium alloys. As result, it is possible to obtain golf clubs which can considerably extend the driving distance of golf balls. In addition, when the present high-strength titanium alloy is used in golf clubs, it is possible to improve the hit feeling and the like of golf clubs, anyway, it is possible to remarkably expand the degree of freedom in designing golf clubs. Of course, not limited to the head of golf clubs, it is relevant likewise when the present titanium alloy is applied to the shaft thereof, and so forth.

In addition to these, the present high-strength titanium alloy can be used in a variety of products in a variety of fields, for example, raw materials (wires, rods, square bars, plates, foils, fibers, fabrics, etc.), portable articles (clocks (wrist watches), barrettes (hair accessories), necklaces, bracelets, earrings, pierces, rings, tiepins, brooches, cuff links, belts with buckles, lighters, nibs of fountain pens, clips for fountain pens, key rings, keys, ballpoint pens, mechanical pencils, etc.), portable information terminals (cellular phones, portable recorders, cases, etc., of mobile personal computers, etc., and the like), springs for engine valves, suspension springs, bumpers, gaskets, diaphragms, bellows, hoses, hose bands, tweezers, fishing rods, fishhooks, sewing needles, sewing-machine needles, syringe needles, spikes, metallic brushes, chairs, sofas, beds, clutches, bats, a variety of wires, a variety of binders, clips for papers, etc., cushioning materials, a variety of metallic seals, expanders, trampolines, a variety of physical fitness exercise apparatuses, wheelchairs, nursing apparatuses, rehabilitation apparatuses, brassieres, corsets, camera bodies, shutter component parts, blackout curtains, curtains, blinds, balloons, airships, tents, a variety of membranes, helmets, fishing nets, tea strainers, umbrellas, firemen's garments, bullet-proof vests, a variety of containers, such as fuel tanks, inner linings of tires, reinforcement members of tires, chassis of bicycles, bolts, rulers, a variety of torsion bars, spiral springs, power transmission belts (hoops, etc., of CVT), and so forth.

EXAMPLES

Hereinafter, the present invention will be described in more detail with reference to specific examples.

Example No. 1

By using the present production process, titanium alloys being Example No. 1 were produced. The present example comprises Sample Nos. 1–1 through 1–10 hereinafter described. In these samples, the proportion of a Va group element was constant, and only the O content was varied. Namely, Ti-24.5Nb-0.7Ta-1.3Zr-xO (at %: x is a variable.) were made. Note that the present example is a case where no cold working step set forth in the present invention was carried out after a hot working step.

First, as a raw material powder, a commercially available hydrogenated-and-dehydrogenated Ti powder (-#325), Nb powder (-#325), Ta powder (-#325) and Zr powder (-#325) were prepared. The Nb powder, Ta powder and Zr powder correspond to the alloying element powders.

Next, the Ti powder was heat treated in air to produce a high-oxygen Ti powder containing a predetermined amount of O (an oxidizing step). The heat treatment conditions in this instance were heating in air at 200° C. and 400° C. for from 30 minutes to 128 hours. This high-oxygen Ti powder and the Nb powder as well as Ta powder and Zr powder were compounded so as to make said composition proportion (at %) and the oxygen proportions (at %) set forth in Table 1, and were further mixed, thereby obtaining desired mixture powders (a mixing step).

These mixture powders were compacted by CIP forming (cold isostatic press forming) at a pressure of 392 MPa (4 ton/cm$^2$), thereby obtaining compacted bodies having a ϕ 40×80 mm cylinder shape (a compacting step).

The resulting compacted bodies were heated in $1.3\times10^{-3}$ Pa ($1\times10^{-5}$ torr) vacuum at 1,300° C. for 16 hours, thereby making sintered billets (a sintering step).

These sintered billets were hot forged in from 700 to 1,150° C. air (a hot working step), thereby obtaining ϕ 10 mm round bars. Regarding the thus obtained respective samples, a variety of later-described measurements were carried out, and the results are set forth in Table 1 altogether.

Example No. 2

The present example was such that the respective samples of Example No. 1 were further subjected to cold working whose cold working ratio was 90% to make Sample Nos. 2-1 through 2-10. Therefore, the composition proportions of Nb, Ta and Zr were as described above. Moreover, in the case of the present example, the steps prior to the hot working step were identical with those of Example No. 1, the steps following the hot working step will be described.

To the ϕ 10 mm round bars after the hot working step, cold swaging was carried out by using a cold swaging machine (a cold working step), thereby manufacturing ϕ 4 mm round bars. Regarding the thus obtained respective samples, a variety of later-described measurements were carried out, and the results are set forth in Table 2.

Example No. 3

By using the present production process, titanium alloys being Example No. 3 were produced. The present example comprises Sample Nos. 3-1 through 3-10 hereinafter described. In these samples, the proportion of a Va group element was constant, and only the O content was varied. Namely, Ti-2ONb-3.5Ta-3.5Zr-xO (at %: x is a variable.) were made. Note that the present example is a case where no cold working step set forth in the present invention was carried out after a hot working step.

First, as a raw material powder, a commercially available hydrogenated-and-dehydrogenated Ti powder (-#325), Nb powder (-#325), Ta powder (-#325) and Zr powder (-#325) were prepared. The Nb powder, Ta powder and Zr powder correspond to the alloying element powders set forth in the present invention.

Next, said Ti powder was heat treated in air to produce a high-oxygen Ti powder containing a predetermined amount of O (an oxidizing step). The heat treatment conditions in this instance were heating in air at 200° C. and 400° C. for from 30 minutes to 128 hours. This high-oxygen Ti powder and the Nb powder as well as Ta powder and Zr powder were compounded so as to make said composition proportion (at %) and the oxygen proportions (at %) set forth in Table 3, and were further mixed, thereby obtaining desired mixture powders (a mixing step).

These mixture powders were compacted by CIP forming (cold isostatic press forming) at a pressure of 392 MPa (4 ton/cm$^2$), thereby obtaining compacted bodies having a ϕ 40×80 mm cylinder shape (a compacting step).

The resulting compacted bodies were heated in $1.3\times10^{-3}$ Pa ($1\times10^{-5}$ torr) vacuum at 1,300° C. for 16 hours, thereby making sintered billets (a sintering step).

These sintered billets were hot forged in from 700 to 1,150° C. air (a hot working step), thereby obtaining ϕ 10 mm round bars. Regarding the thus obtained respective samples, a variety of later-described measurements were carried out, and the results are set forth in Table 3 altogether.

Example No. 4

The present example was such that the respective samples of Example No. 3 were further subjected to cold working whose cold working ratio was 90% to make Sample Nos. 4-1 through 4-10. Therefore, the composition proportions of Nb, Ta and Zr were as described above. Moreover, in the case of the present example, the steps prior to the hot working step were identical with those of Example No. 3, and the cold working step was identical with that of Example No. 2. Regarding the thus obtained respective samples, a variety of later-described measurements were carried out, and the results are set forth in Table 2.

Example No. 5

The present example was such that Sample No. 2-5 of Example No. 2 was further subjected to an age treatment at 400° C. for 24 hours (an age-treatment step) to make Sample No. 5-5. Regarding this sample as well, a variety of measurements described later were carried out, and the results are set forth in Table 5.

Measurements on Respective Samples

Tensile characteristics were determined from stress-strain diagrams by carrying out a tensile test with an Instron (a name of a maker) testing machine.

TABLE 1

| | Production Conditions | | | | Tensile |
|---|---|---|---|---|---|
| Sample No. | Oxygen Content at % | Working History | Reduction φ % | Elongation δ % | Strength σ MPa |
| 1-1 | 2.00 | Hot Working | 42.4 | 16.9 | 1002 |
| 1-2 | 2.44 | Hot Working | 42.4 | 15.8 | 1009 |
| 1-3 | 2.48 | Hot Working | 43.5 | 15.0 | 1120 |
| 1-4 | 2.68 | Hot Working | 35.8 | 18.2 | 1201 |
| 1-5 | 2.80 | Hot Working | 28.5 | 9.9 | 1233 |
| 1-6 | 3.32 | Hot Working | 20.2 | 8.5 | 1310 |
| 1-7 | 4.00 | Hot Working | 18.5 | 8.8 | 1350 |
| 1-8 | 4.50 | Hot Working | 15.0 | 7.0 | 1408 |
| 1-9 | 5.20 | Hot Working | 10.0 | 6.8 | 1433 |
| 1-10 | 6.00 | Hot Working | 11.8 | 6.1 | 1465 |

TABLE 2

| | Production Conditions | | | | Tensile |
|---|---|---|---|---|---|
| Sample No. | Oxygen Content at % | Working History | Reduction φ % | Elongation δ % | Strength σ MPa |
| 2-1 | 2.00 | Hot & Cold Working | 47.5 | 11.2 | 1125 |
| 2-2 | 2.44 | Hot & Cold Working | 46.7 | 10.9 | 1196 |
| 2-3 | 2.48 | Hot & Cold Working | 49.4 | 10.6 | 1389 |
| 2-4 | 2.68 | Hot & Cold Working | 41.7 | 11.1 | 1439 |
| 2-5 | 2.80 | Hot & Cold Working | 28.5 | 10.7 | 1475 |
| 2-6 | 3.32 | Hot & Cold Working | 21.2 | 10.0 | 1510 |
| 2-7 | 4.00 | Hot & Cold Working | 20.0 | 9.5 | 1558 |
| 2-8 | 4.50 | Hot & Cold Working | 14.8 | 8.0 | 1610 |
| 2-9 | 5.20 | Hot & Cold Working | 9.9 | 5.0 | 1655 |
| 2-10 | 6.00 | Hot & Cold Working | 8.0 | 5.5 | 1672 |

TABLE 3

| | Production Conditions | | | | Tensile |
|---|---|---|---|---|---|
| Sample No. | Oxygen Content at % | Working History | Reduction φ % | Elongation δ % | Strength σ MPa |
| 3-1 | 2.10 | Hot Working | 55.9 | 18.5 | 1065 |
| 3-2 | 2.25 | Hot Working | 46.6 | 15.6 | 1096 |

TABLE 3-continued

| | Production Conditions | | | | Tensile |
|---|---|---|---|---|---|
| Sample No. | Oxygen Content at % | Working History | Reduction φ % | Elongation δ % | Strength σ MPa |
| 3-3 | 2.46 | Hot Working | 48.6 | 15.0 | 1139 |
| 3-4 | 2.72 | Hot Working | 44.3 | 14.6 | 1211 |
| 3-5 | 2.83 | Hot Working | 40.3 | 21.0 | 1236 |
| 3-6 | 3.02 | Hot Working | 20.2 | 15.0 | 1325 |
| 3-7 | 3.87 | Hot Working | 13.6 | 8.4 | 1380 |
| 3-8 | 4.39 | Hot Working | 14.6 | 7.5 | 1408 |
| 3-9 | 5.00 | Hot Working | 12.2 | 6.9 | 1433 |
| 3-10 | 5.69 | Hot Working | 15.0 | 7.0 | 1465 |

TABLE 4

| | Production Conditions | | | | Tensile |
|---|---|---|---|---|---|
| Sample No. | Oxygen Content at % | Working History | Reduction φ % | Elongation δ % | Strength σ MPa |
| 4-1 | 2.10 | Hot & Cold Working | 58.6 | 11.2 | 1178 |
| 4-2 | 2.25 | Hot & Cold Working | 50.9 | 10.9 | 1193 |
| 4-3 | 2.46 | Hot & Cold Working | 49.4 | 10.6 | 1389 |
| 4-4 | 2.72 | Hot & Cold Working | 48.4 | 11.1 | 1476 |
| 4-5 | 2.83 | Hot & Cold Working | 41.9 | 11.8 | 1463 |
| 4-6 | 3.02 | Hot & Cold Working | 29.5 | 10.7 | 1569 |
| 4-7 | 3.87 | Hot & Cold Working | 18.7 | 9.8 | 1549 |
| 4-8 | 4.39 | Hot & Cold Working | 15.3 | 7.6 | 1603 |
| 4-9 | 5.00 | Hot & Cold Working | 10.6 | 6.1 | 1688 |
| 4-10 | 5.69 | Hot & Cold Working | 13.4 | 6.3 | 1685 |

TABLE 5

| | Production Conditions | | | | Tensile |
|---|---|---|---|---|---|
| Sample No. | Oxygen Content at % | Working History | Reduction φ % | Elongation δ % | Strength σ MPa |
| 5-5 | 2.80 | Hot & Cold Working & 400° C. for 12 hours | 10.0 | 3.1 | 2011 |

Assessment on Respective Test Samples

From the results set forth in Tables 1 through 5, the following are understood.

(1) Strength

All of the present titanium alloys were such that the tensile strength was 1,000 MPa or more. In particular, when they are subjected to cold working, the tensile strength was strengthened much more highly to 1,100 MPa or more.

(2) Reduction and Elongation

The present titanium alloys were such that about 10% reduction was obtained at the minimum. Moreover, all of the titanium alloys were such that the elongation exceeded 3% naturally and even 5% and accordingly high elongations were obtained, and the respective samples of the examples were of remarkably high ductility.

(3) Oxygen Content

① While exemplifying cold worked titanium alloys (Example No. 2), how the oxygen content affected the strength will be hereinafter recapitulated.

The present titanium alloy was such that the improvement of the strength was remarkable, and a high-strength material such as 1,700 MPa at the maximum could be obtained. Moreover, even when it had a high oxygen content, it secured a reduction of about 10% or more. The elongation hardly lowered until the oxygen content increased up to 4.5 at %, and showed a value close to 10%.

Ordinary titanium alloys are produced so as to suppress the oxygen content to 0.7 at % or less, or 1.0 at % at the maximum. This is because, although the strength improves, the elongation lowers when the oxygen content increases. In particular, in the case of high-strength materials, it has been common knowledge that the oxygen content is controlled very strictly.

Despite that, in the case of the present titanium alloy, the ductility scarcely lowered even when the oxygen content increased, and high ductility was exhibited. This is exactly a unique phenomenon, and one of the indications that the present titanium alloy is totally different from conventional titanium alloys.

② Next, how the tensile strength and elongation were affected by the variation of the oxygen content was examined specifically on the present titanium alloy and conventional titanium alloy. This was made into a graph, and is shown in FIG. 5.

Figure 5:
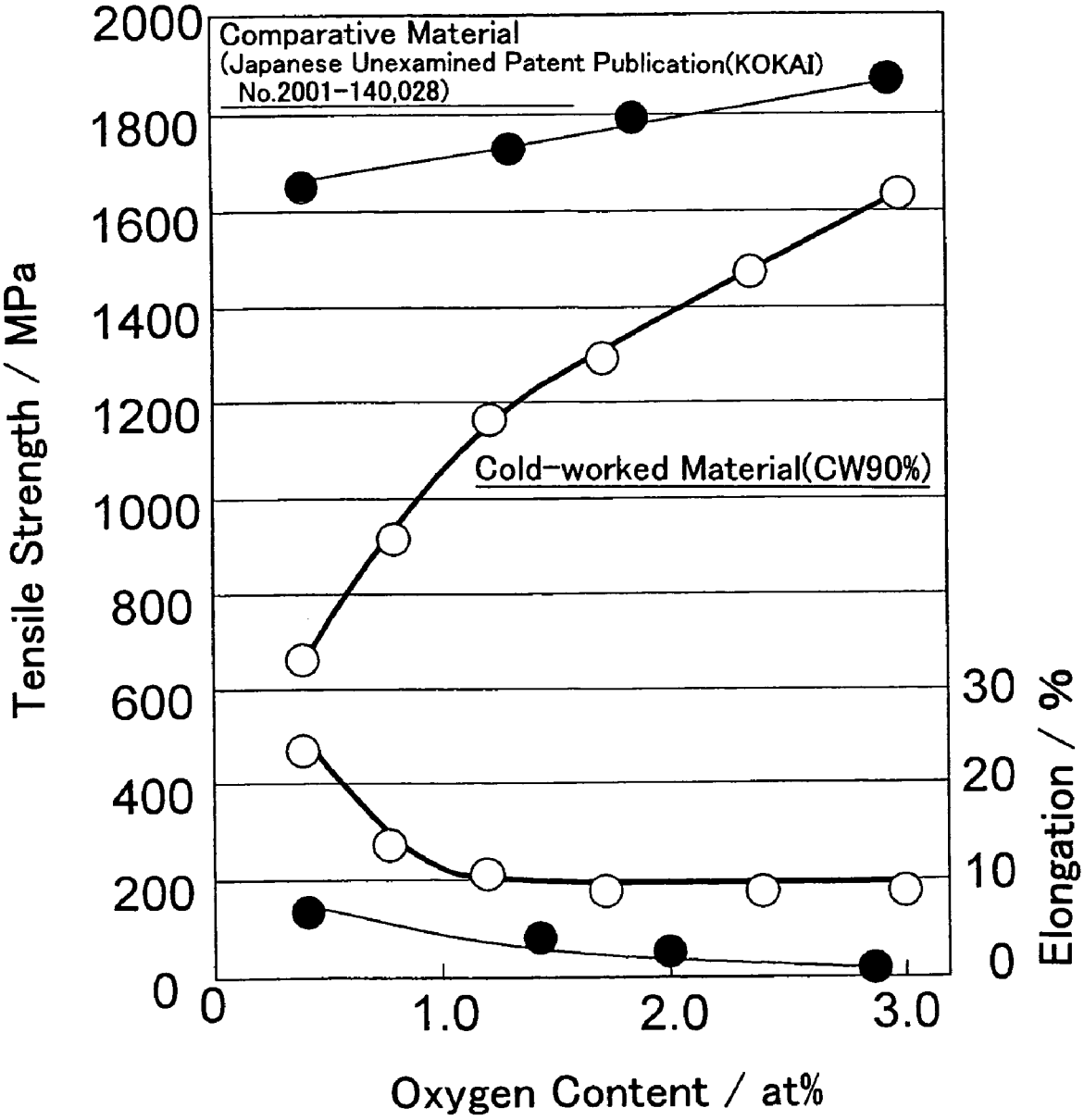
FIG. 5 is a graph for comparing influences on tensile strength and elongation exerted by oxygen contents in a titanium alloy according to the present invention with those in a comparative material.

The cold worked material (cold working ratio (CW) 90%) shown in FIG. 5 is a titanium alloy according to the present invention which had a composition of Ti-8.9Nb-11.5Ta-2.7V-0.08Zr (at %), and which was produced by the same method as those of above-described Example No. 1 and Example No. 2. Moreover, the measurement methods of the respective data were likewise as described above.

A comparative material with respect to this was based on a high-strength titanium alloy disclosed in Preferred Embodiment Nos. 1 through 3 of Japanese Unexamined Patent Publication (KOKAI) No. 2001-140,028. Specifically, it comprised an ingot material which had a composition of Ti-5% Al-2% Sn-2% Zr-4% Mo-4% Cr-x % O by wt % (Ti-8.9% Al-0.8% Sn-1.1% Zr-2.0% Mo-3.7% Cr-y % O by at %). It is needless to say that, regarding the composition of Va group element, the comparative material is totally different from the titanium alloy according to the present invention.

When observing FIG. 5, it is apparent that not only the titanium alloy according to the present invention but also the comparative material were highly strengthened as the O content increased.

However, in the case of the comparative material, as it was highly strengthened, the elongation (ductility) lowered remarkably.

On the other hand, not only the titanium alloy according to the present invention was highly strengthened, but also the elongation hardly lowered even when the O content increased. For example, even in a high-oxygen region where the oxygen content exceeded 1.5 at %, high elongations in the vicinity of 10% were sustained stably. Accordingly, when the present titanium alloy is used, contrary to conventional titanium alloys like the comparative material, it is possible to obtain a good working property along with being of high strength, and consequently it is possible to reduce the costs required for forming and the like and to improve the material yield and so forth.

Thus, in accordance with the present high-strength titanium alloy, since high strength and high ductility are made compatible, it is possible to further expand the utilization of titanium alloys whose usage has been limited to special fields so far. Moreover, in accordance with the present production process, it is possible to obtain such a titanium alloy with ease.

The invention claimed is:

1. A high-strength titanium alloy, comprising:

titanium (Ti) as a major component;

15 to 30 at % of a Va group element; and 2.4 to 6 at % of oxygen (O) when the entirety is taken as 100 atomic % (at %);

wherein the alloy tensile strength is 1,000 MPa or more, and wherein the alloy has a fault-shaped deformation structure obtained by subjecting the alloy to cold working.

2. A high-strength titanium alloy of claim 1, having an elongation of 3% or more.

3. A high-strength titanium alloy of claim 1, wherein said O is from 2.6 to 6.0 at %.

4. A high-strength titanium alloy of claim 1, wherein said Va group element is at least one member selected from the group consisting of vanadium (V), niobium (Nb) and tantalum (Ta), and is included in a summed amount of from 18 to 27 at %.

5. A high-strength titanium alloy of claim 1, further comprising at least one metallic element selected from the group consisting of zirconium (Zr), hafnium (Hf) and scandium (Sc), wherein Zr is 15 at % or less, Hf is 10 at % or less, and Sc is 30 at % or less.

6. A high-strength titanium alloy of claim 1, further comprising 13 at % tin (Sn) or less.

7. A high-strength titanium alloy of claim 1, further comprising at least one metallic element selected from the group consisting of chromium (Cr), molybdenum (Mo), manganese (Mn), iron (Fe), cobalt (Co) and nickel (Ni), wherein Cr, Mn and Fe are 30 at % or less, respectively, Mo is 20 at % or less, and Co and Ni are 13 at % or less, respectively.

8. A high-strength titanium alloy of claim 1, further comprising from 0.5 to 12 at % aluminum (Al).

9. A high-strength titanium alloy of claim 1, further comprising from 0.2 to 6.0 at % boron (B).

10. A high-strength titanium alloy of claim 1, which has been subjected to an age treatment whose treatment temperature is from 200° C. to 500° C.

* * * * *